US011056090B2

(12) United States Patent
Martin et al.

(10) Patent No.: US 11,056,090 B2
(45) Date of Patent: Jul. 6, 2021

(54) ELASTIC MATERIAL FOR COUPLING TIME-VARYING VIBRO-ACOUSTIC FIELDS PROPAGATING THROUGH A MEDIUM

(71) Applicant: The Government of the United States of America, as represented by the Secretary of the Navy, Arlington, VA (US)

(72) Inventors: Theodore P. Martin, Delmar, NY (US); Charles Alan Rohde, Brentwood, MD (US); Gregory Orris, Kensington, MD (US); Kristin Charipar, Alexandria, VA (US); Alberto Piqué, Crofton, MD (US)

(73) Assignee: The Government of the United States of America, as represented by the Secretary of the Navy, Washington, DC (US)

( * ) Notice: Subject to any disclaimer, the term of this patent is extended or adjusted under 35 U.S.C. 154(b) by 513 days.

(21) Appl. No.: 16/049,943

(22) Filed: Jul. 31, 2018

(65) Prior Publication Data

US 2019/0035374 A1 Jan. 31, 2019

Related U.S. Application Data

(60) Provisional application No. 62/538,933, filed on Jul. 31, 2017.

(51) Int. Cl.
*G10K 11/162* (2006.01)
*G10K 11/02* (2006.01)
(Continued)

(52) U.S. Cl.
CPC ..... *G10K 11/162* (2013.01); *G10K 11/02* (2013.01); *G10K 11/04* (2013.01); *G10K 11/205* (2013.01); *G10K 2200/11* (2013.01)

(58) Field of Classification Search
CPC ..... G10K 11/162; G10K 11/02; G10K 11/04; G10K 11/205; G10K 2200/11
See application file for complete search history.

(56) References Cited

U.S. PATENT DOCUMENTS 7,733,198 B1 * 6/2010 Olsson ..... G10K 11/20 333/187
7,836,566 B1 * 11/2010 Olsson ..... G10K 11/20 29/25.35

(Continued)

FOREIGN PATENT DOCUMENTS

EP 1246162 A1 * 10/2002 ..... G10K 11/16

OTHER PUBLICATIONS

Mousanezhad et al., Elastic Properties of Chiral, Anti-chiral, and Hierarchical Honeycombs: A Simple Energy-based Approach, Theoretical and Applied Mechanics Letters, Mar. 11, 2016, pp. 81-96, vol. 6, Elsevier Ltd. on behalf of The Chinese Society of Theoretical and Applied Mechanics, New York, NY, USA.

(Continued)

*Primary Examiner* — Forrest M Phillips
(74) *Attorney, Agent, or Firm* — US Naval Research Laboratory; Suresh Koshy

(57) ABSTRACT

A device for use in a medium comprising a medium vibro-acoustic impedance. The device includes an elastic material including a plurality of unit cells. The plurality of unit cells includes a first unit cell. The first unit cell includes a first unit-cell joint comprising a first unit-cell joint wall defining a first joint central void, a first unit-cell joint inclusion located in the first joint central void, and at least two first unit-cell arms connected to and extending away from the first unit-cell joint. The elastic material includes an elastic-material vibro-acoustic impedance. The elastic-material vibro-acoustic impedance and the medium vibro-acoustic impedance are sufficiently vibro-acoustically impedance- (Continued)

matched to couple time-varying, propagating vibro-acoustic fields between said elastic material and the medium.

19 Claims, 7 Drawing Sheets

(51) Int. Cl.
*G10K 11/04* (2006.01)
*G10K 11/20* (2006.01)

(56) References Cited

U.S. PATENT DOCUMENTS 8,309,181 B2 * 11/2012 Ishizuka ..... B82Y 10/00 427/385.5
8,863,897 B2 * 10/2014 Bertolini ..... G10K 11/002 181/290
8,875,838 B1 * 11/2014 Yano ..... G10K 11/16 181/286
2011/0100746 A1 * 5/2011 Berker ..... E04B 1/86 181/286
2019/0039093 A1 * 2/2019 Semperlotti ..... B06B 1/18

OTHER PUBLICATIONS

Chen et al., Elasticity of Anti-Tetrachiral Anisotropic Lattices, International Journal of Solids and Structures, Dec. 21, 2012, pp. 996-1004, vol. 50, Elsevier Ltd., New York, NY, USA.
Wu etal., Isotropic Negative Thermal Expansion Metamaterials, Applied Materials & Interfaces, Jun. 22, 2016, pp. 17721-17727, vol. 8, American Chemical Society, Washington, DC, USA.
Mousanezhad et al., Hierarchical Honeycomb Auxetic Metamaterials, Scientific Reports, Dec. 16, 2015, pp. 1-8, vol. 5, No. 18306, Nature Publishing Group, London, UK.
Kolken et al., Auxetic Mechanical Metamaterials, RSC Advances, Jan. 17, 2017, pp. 5111-5129, vol. 7, Royal Society of Chemistry, London, UK.
Buckmann et al., On Three-dimensional Dilational Elastic Metamaterials, New Journal of Physics, Mar. 26, 2014, pp. 1-17, vol. 16, No. 033032, IOP Publishing Ltd. and Deutsche Physikalische Gesellshaft, Bristol, UK.
Bacigalupo et al., Optimal Design of Low-Frequency Band Gaps in Anti-Tetrachiral Lattice Meta-materials, arXiv, Aug. 2, 2016, pp. 1-33, vol. 1608.01077v1, Cornell University, Ithaca, NY, USA.

* cited by examiner 500
522
521
102

510
505
532
534
536
503
521
102
507
506
204

520
505
504
102
507
508
204

530
525
524
102
527
526
102

540
536
511
102
112
538
537
512
202

550
528
541
102
544
542

560
514
513
102
546
548
516
515
204

ELASTIC MATERIAL FOR COUPLING TIME-VARYING VIBRO-ACOUSTIC FIELDS PROPAGATING THROUGH A MEDIUM

CROSS-REFERENCE TO RELATED APPLICATIONS

This application claims priority to U.S. Provisional Patent Application Ser. No. 62/538,933, entitled "METHODS OF GEOMETRIC ALTERATION TO ENABLE ACOUSTO-ELASTIC METAMATERIAL FUNCTIONALITY WITHIN ANTI-TETRACHIRAL LATTICE GEOMETRIES," to Martin, which was filed on 31 Jul. 2017 and is incorporated herein by reference.

FIELD OF THE INVENTION

The present invention relates in general to articles of manufacture including heterogeneous elastic composites as well as methods of manufacturing same, and relates more particularly to heterogeneous elastic composites that exhibit a vibro-acoustic impedance match with other fluid and elastic materials as well as the method of manufacturing same.

BACKGROUND OF THE INVENTION

Truss-like lattice structures, where elastic beams are connected together at joints to form a regular lattice of geometries, support an extra degree of flexural motion due to the absence of an elastic boundary condition at the beams' outer surfaces. Chiral and anti-chiral lattice structures feature truss beams, termed "arms" for the purpose of this specification, which extend from joints with a specific rotational handedness to form a chiral geometry. The presence of truss beams in such lattices can produce a particularly low vibro-acoustic stiffness when compared to the stiffness of their component materials due to this flexural degree of freedom. The low vibro-acoustic stiffness in turn leads to low vibro-acoustic wave speeds and short wavelengths, which are essential design features for applications that rely on vibro-acoustic phase mitigation and resonance. While chiral and anti-chiral lattices are known in the art, their use in applications that mitigate vibro-acoustic wave propagation in other media has been limited to a narrow range of media with vibro-acoustic impedance that approximately matches that of the chiral lattice structures. This limitation is due to the physical requirement that the vibro-acoustic impedance of two media must be similar in order to exchange a significant amount of vibro-acoustic energy between the media.

In the simplified case of a vibro-acoustic wave propagating at normal incidence to the interface between two media, the vibro-acoustic impedance $Z \propto \sqrt{C}P$ of each medium is proportional to the square root of the medium's vibro-acoustic stiffness C and density ρ. Here, C is the relevant stiffness tensor component for a particular elastic wave polarization in elastic media, while C is the bulk modulus for fluid media. For a given homogenous material, both chiral and anti-chiral lattices made from that material can have lower vibro-acoustic stiffnesses than the material itself. In accordance with the vibro-acoustic impedance relationship, the density of the lattices would have to increase in proportion to the decrease in stiffness in order to keep the impedance of the lattice matched to its component homogenous material. In an embodiment with no density alteration, the chiral and anti-chiral lattices would be impedance-matched to external media with lower vibro-acoustic impedance.

Matching the vibro-acoustic impedance of such lattices is particularly challenging when the matching medium is similar to a dense fluid such as water. Many common elastic materials such as plastics, ceramics, metals, semiconductors, organic and biological matter have vibro-acoustic impedances that are at least similar to and often higher than water. Taking water as an example, it is possible to reduce the vibro-acoustic stiffness of chiral and anti-chiral lattices made from plastic materials to achieve wave speeds of less than a tenth of water. The low stiffness and phase speed are achieved by removing material to form the chiral configuration of arms, but this removal of material simultaneously decreases the density of the plastic lattice, further reducing the lattice's impedance compared to water. Although such low wave speeds are advantageous for phase mitigation and resonance applications, particularly those that require compact spatial designs, the accompanying low impedance compared with water makes these lattices impractical for exchanging vibro-acoustic energy between the lattices and a volume of water.

BRIEF SUMMARY OF THE INVENTION

An embodiment of the invention includes a device for use in a medium comprising a medium vibro-acoustic impedance. The device includes an elastic material including a plurality of unit cells. The plurality of unit cells includes a first unit cell. The first unit cell includes a first unit-cell joint comprising a first unit-cell joint wall defining a first joint central void, a first unit-cell joint inclusion located in the first joint central void, and at least two first unit-cell arms connected to and extending away from the first unit-cell joint. The elastic material includes an elastic-material vibro-acoustic impedance. The elastic-material vibro-acoustic impedance and the medium vibro-acoustic impedance are sufficiently vibro-acoustically impedance-matched to couple time-varying, propagating vibro-acoustic fields between said elastic material and the medium.

An embodiment of the instant invention includes heterogeneous chiral and anti-chiral lattices for use in mitigating the propagation of vibro-acoustic wave fields. An illustrative goal of the embodiment is to enable the phase manipulation of such wave fields when the wave fields are reflected from or transmitted through the lattices.

An embodiment of the invention includes heterogeneous elastic composites having a vibro-acoustic impedance match with the surrounding or adjacent fluid and elastic materials. The impedance match enables the coupling of vibro-acoustic wave fields between the elastic composites and at least one external medium, where the vibro-acoustic wave propagation in the external medium can in turn be controlled and mitigated through the proper design of such composites. It finds particular application in conjunction with utilizing chiral lattice structures, which can be designed to have low vibro-acoustic wave speeds compared to their underlying material components, and will be described with particular reference thereto. However, it is to be appreciated that the present exemplary embodiments are also amenable to other like applications.

Another embodiment of the invention includes the chiral and/or anti-chiral lattices selected to exhibit a low vibro-acoustic stiffness, while simultaneously increasing the impedance of the lattice. This embodiment of the invention maintains the vibro-acoustic impedance at a value close to that of a particular medium, irrespective of the selection of differing vibro-acoustic wave speeds at different spatial locations within the lattice.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION OF INVENTION

Figure 1B:
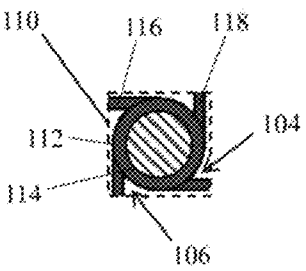
FIG. 1B is a schematic diagram of a sub-unit of an anti-tetrachiral unit cell in accordance with the present invention.

A more complete understanding of devices, articles of manufacture, and/or processes disclosed herein can be obtained by reference to the accompanying figures. These figures are merely schematic representations based on convenience and the ease of demonstrating the present invention, and are, therefore, not intended to indicate relative size and dimensions of the devices or components thereof and/or to limit the scope of the exemplary embodiments.

Although specific terms are used in the following description for the sake of clarity, these terms are intended to refer only to the particular structure of the embodiments selected for illustration in the drawings, and are not intended to limit the scope of the disclosure.

An objective of the instant invention is to create an elastic material that couples propagating vibro-acoustic fields from a first medium that supports the propagation of such fields to a second medium. In an embodiment of the invention, the second coupled medium is the elastic material itself. For the purpose of the instant specification, the term "propagating vibro-acoustic field" refers to a time-varying oscillation in the position of particles that make up a medium, which includes acoustic wave fields in fluids and elastic wave fields in solids. In some embodiments of the invention, when the elastic material is made up of an underlying lattice of chiral structures, the wave speed of the vibro-acoustic propagating fields in the lattice becomes significantly reduced compared to the characteristic compressional wave speed of the base material used to form the lattice. In some embodiments of the invention, the wave speed in the lattice is significantly lower than one or more wave speeds in the coupled media. Lower wave speeds produce shorter wavelengths, which in turn result in resonance phenomena at lower frequencies compared with a higher wave speed medium. Shorter wavelengths also improve the dissipation of energy that is contained in a propagating vibro-acoustic field when the field propagates across a particular spatial distance.

In one or more embodiments of the invention, low wave speeds in the elastic material are spatially dependent and advance or retard the phase of propagating vibro-acoustic fields in different amounts depending on the spatial location within the lattice. An underlying goal of an embodiment of the invention is to maintain the coupling between a medium and the elastic material when the wave speed and phase modulation are spatially dependent.

Figure 1A:
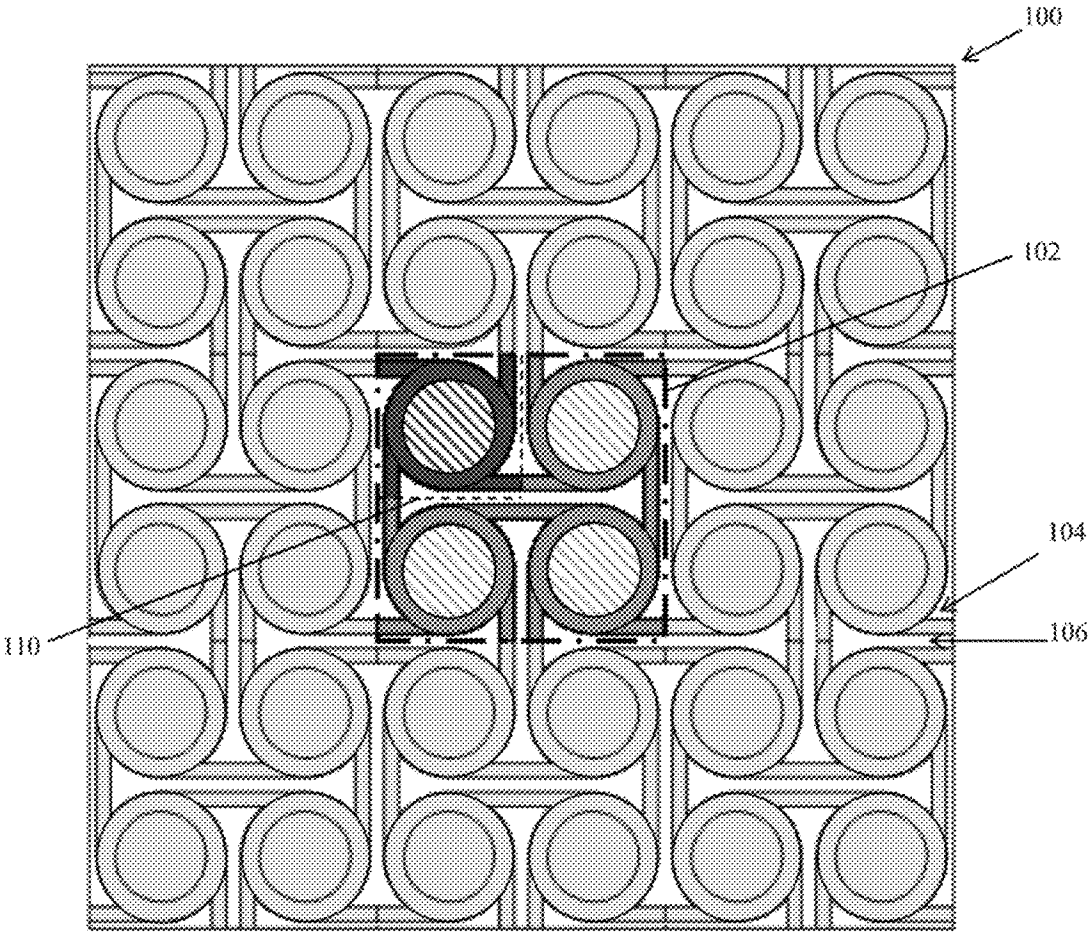
FIG. 1A is a schematic diagram of an elastic material comprising a plurality of unit cells that form an anti-tetrachiral lattice in accordance with the present invention.

For an embodiment of the invention, FIGS. 1A and 1B illustrate an elastic material including a plurality of unit cells 100. The plurality of unit cells 100 is also defined as a "lattice." In an embodiment of the invention such as shown in FIG. 1A, the plurality of unit cells 100 is depicted as an anti-tetrachiral lattice. Although FIG. 1A shows a two-dimensional lattice, in another embodiment of the invention, the number of unit cells in the lattice 100 is extended in the three orthogonal Cartesian directions to create a three-dimensional elastic material of size appropriate for a user's application. In another embodiment of the invention, the two-dimensional lattice 100 is extruded out of plane. FIG. 1A shows an illustrative unit cell 102 as outlined by a rectangle with a dash-dot-styled border. Each unit cell 102 of the lattice is composed of at least one sub-unit 110. FIG. 1A shows an illustrative sub-unit cell 110 as outlined by a rectangle with a dash-dash-styled border. For clarity, in FIG. 1A, the rectangular border around unit cell 102 includes dots and dashes, and the rectangular border around sub-unit cell 110 includes dashes. Each sub-unit 110 includes a joint, which in turn includes an elastic joint wall 112 that encloses a joint central void 114. Each joint wall 112 is connected to adjacent joint walls by at least two elastic connecting arms 116, 118, where the adjacent joint walls are in the same unit cell 102 or an adjacent unit cell. FIGS. 1A and 1B show four connecting arms for ease of understanding. However, one of ordinary skill in the art will readily appreciate that the number of connecting arms depends on the user's application and optionally includes two, three, or more than four connecting arms. FIGS. 1A and 1B show connecting arms that extend straight without curvature for ease of understanding. However, one of ordinary skill in the art will readily appreciate that the curvature of the connecting arms depends on the user's application and that the arms optionally curve to connect two adjacent joint walls at varying locations.

The joint walls 112 and connecting arms 116, 118 are separated by gaps 104, 106. Although only two gaps are shown in FIGS. 1A and 1B, one of ordinary skill in the art will readily appreciate that the number of gaps depends on the user's application and optionally includes one, three, or more gaps. The gaps 104, 106 are filled with a standard material that allows the connecting arms 116, 118 to flex out of plane, where one of the vectors that defines the flexural plane is parallel to the direction of the connecting arm's extension between the joint walls. In an embodiment of the invention, the material comprising the gaps 104, 106 includes a standard low-viscosity material, such as a standard fluid. In another embodiment of the invention, the gaps 104, 106 are left vacant, thereby enclosing a vacuum or air. In still another embodiment, the gaps 104, 106 are filled with a standard elastic material with a bulk modulus, shear modulus, and density that does not fully suppress the propagation of vibro-acoustic waves along the connecting arms 116, 118.

In the exemplary embodiment shown in FIGS. 1A and 1B, the unit cell 102 of the lattice has connecting arms 116, 118 oriented in an anti-chiral geometry. In some embodiments of the invention, the unit cell 102 has connecting arms 116, 118 oriented in a chiral geometry. In other embodiments of the invention, the plurality of unit cells 100 include an anti-trichiral lattice, a trichiral lattice, or a tetrachiral lattice.

An illustrative goal of the instant invention is to create a material that couples time-varying, propagating vibro-acoustic fields between the lattice 100 and an exterior medium when the exterior medium is brought into mechanical contact with the lattice. The term "coupling" is defined herein as the act of bringing the exterior medium into mechanical contact with the lattice 100 such that some fraction of energy contained in a propagating vibro-acoustic field transfers between the two media. In an embodiment of the invention, the exterior medium is, for example, a standard fluid or a standard elastic material, and the exterior medium is, for example, a standard homogenous material or a standard heterogeneous material. In another embodiment of the invention, the aforementioned heterogeneous material includes another lattice. In order to achieve sufficient coupling between the exterior medium and the lattice, the material composition of the joint central void 114 is chosen such that the plurality of unit cells 100 as a whole are approximately vibro-acoustically impedance-matched to the exterior medium. For the purpose of the present specification, an "approximate" impedance match is defined as a vibro-acoustic impedance contrast between the lattice 100 and the exterior medium that is sufficiently small such that the transferred portion of the propagating vibro-acoustic field's energy achieves the goal of an application-specific embodiment of the invention under consideration.

The primary purpose of selecting the material composition of the joint central voids 114 is to achieve a predetermined dynamic composite density of the plurality of unit cells 100 as a whole. The "dynamic composite density" is defined herein as the density that the lattice appears to have if the lattice were assumed to be a homogenous medium at a given frequency of vibro-acoustic oscillation. The dynamic composite density has also been termed an "effective density" in the relevant literature. Selecting the material composition of the joint central voids 114 in this way determines the density of the lattice without significantly impacting the vibro-acoustic and mechanical stiffnesses of the plurality of unit cells 100. Furthermore, the freedom to select the composite density of the plurality of unit cells 100, while leaving the composite vibro-acoustic stiffness only slightly perturbed, provides a means of selecting the vibro-acoustic wave speed of the lattice while maintaining approximately the same stiffness. In an embodiment of the invention, the joint central voids 114 are, for example, filled with a standard acoustic fluid or a standard elastic material, and the central voids 114 are, for example, filled with a standard homogenous or a standard heterogeneous material. In another embodiment of the invention, the central voids 114 are, for example, filled with a combination of such standard materials.

Figures 2A, 2B, 2C, 2D:
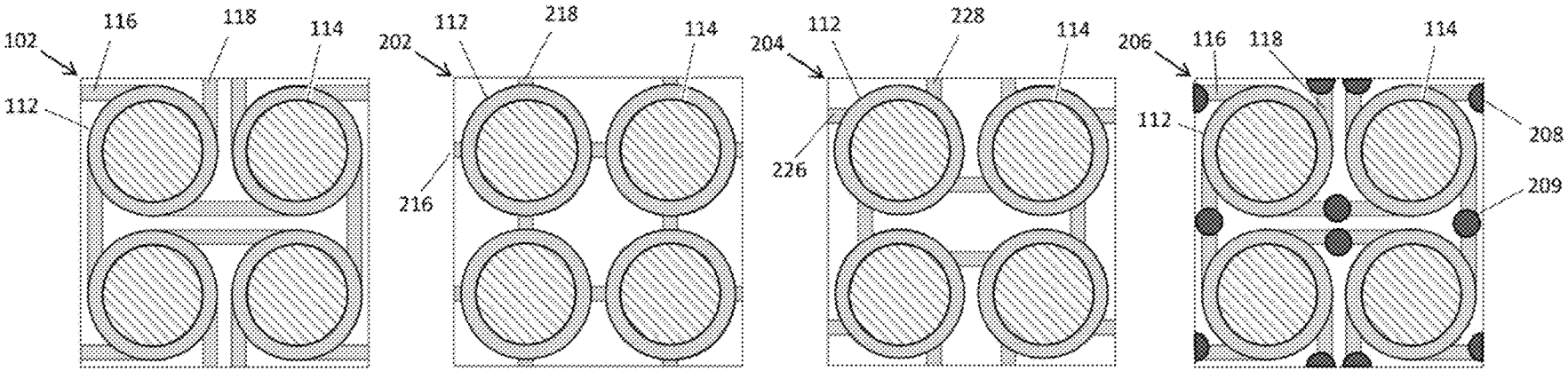
FIG. 2A is a schematic diagram of a unit cell having connecting arms that extend from the edge of the unit cell joint wall in accordance with the present invention.
FIG. 2B is a schematic diagram of a unit cell having connecting alms that extend from the center of the unit cell joint wall in accordance with the present invention.
FIG. 2C is a schematic diagram of a unit cell having connecting arms that extend from a point between the edge and the center of the unit cell joint wall in accordance with the present invention.
FIG. 2D is a schematic diagram of a unit cell with additional material added to the connecting arms in accordance with the present invention.

Another illustrative goal of this invention is to create a material that has a geometrically-tunable vibro-acoustic wave speed, but that simultaneously maintains the coupling of propagating vibro-acoustic fields between the plurality of unit cells 100 and an exterior medium or media. In order to accomplish this goal, a second mechanism is required to select the dynamic composite stiffness of the plurality of unit cells as a whole without significantly modifying the density of the lattice. The "dynamic composite stiffness" is defined herein as the stiffness that the lattice appears to have if the lattice were assumed to be a homogenous medium at a given frequency of vibro-acoustic oscillation. The dynamic composite stiffness has also been termed an "effective stiffness" in the relevant literature. The second mechanism is to select the position and orientation of the connecting arms 116, 118. As illustrated for the embodiment of an anti-tetrachiral unit cell 102, 202, 204, 206 in FIGS. 2A-2D, the position of the connecting arms can be located at the edge 116, 118 of the joint wall 112 (e.g., as shown in FIG. 2A), at the center 216, 218 of the joint wall (e.g., as shown in FIG. 2B), or in between the edge and center 226, 228 of the joint wall (e.g., as shown in FIG. 2C), in each case without changing the direction of extension of the connecting arms. The embodiment of the invention shown by way of illustration in FIG. 2B represents the special case where the chiral asymmetry of the unit cell is lost. An embodiment of the invention, shown by way of illustration in FIG. 2A, represents the geometric configuration of the unit cell 102 with the lowest stiffness, while the embodiment of the invention, shown by way of illustration in FIG. 2B, represents the highest stiffness configuration. One of ordinary skill in the art will readily appreciate that positioning of the connecting arms between these two extremes allows for the selection of a stiffness appropriate for the user's application. By simultaneously selecting the geometric position of the connecting arms 116, 118, 216, 218, 226, 228 and the material composition of the central joint voids 114, both the vibro-acoustic wave speed and impedance of the lattice can be independently selected. In this way, the vibro-acoustic wave speed of the lattice can be selected to have a plurality of values while preserving an approximate impedance match with an exterior medium.

In some embodiments of the invention, the connecting arms 116, 118 do not have a uniform thickness across their extensions. In other embodiments of the invention, such as that shown in FIG. 2D, additional material or materials 208, 209 are added to the connecting arms 116, 118 and serve to provide an additional means of selecting the dynamic composite density and stiffness of the lattice. The additional materials 208, 209 include standard heterogeneous or standard homogeneous elastic materials, and their geometry (or geometries) with respect to the connecting arms 116, 118 can be selected to meet the requirements of the specific user's application; the geometries of the additional materials 208, 209 are, for example, standard shapes such as circles, squares, and triangles. The additional material 208 need not be the same as the additional material 209 located in a different part of the unit cell 206, and their respective geometries need not be the same.

The material composition of the joint walls 112, the connecting arms 116, 118, the joint central voids 114, the gaps 104, 106, and the additional materials 208, 209 added to the connecting arms depend on the user's intended application. For example, in an illustrative embodiment the joint walls and connecting arms are made from a standard semiconductor, a standard metal, a standard metal alloy, a standard polymer, a standard foam, a standard gel, a standard rubber, a standard elastic composite, and/or a standard ceramic that is amenable to manufacturing using a standard three-dimensional additive build process. Examples of such a metal include steel and titanium, an example of such a ceramic is alumina, and an example of such a polymer is acrylonitrile butadiene styrene. In some embodiments of the invention, the polymers used in an additive build process are standard plastics. After manufacturing the joint walls and connecting arms, the joint central voids and gaps are optionally filled in with other standard materials. Examples of such filling materials are standard fluids, standard foams, standard gels, and other standard solids.

In an illustrative embodiment that is intended to be impedance-matched with the exterior medium of water, the joint walls and connecting arms are manufactured out of acrylonitrile butadiene styrene using a standard additive build process. The joint central voids are filled with tungsten, where the tungsten is inserted using rods that have the same cross-sectional geometry as the joint central voids. The gaps are filled with air. In the aforementioned embodiment of the invention, the compressional wave speed of the lattice can be reduced to $1/10^{th}$ that of water while maintaining a vibro-acoustic impedance match with water. Tungsten increases the dynamic composite density of the lattice to simultaneously reduce the vibro-acoustic wave speed and to increase the impedance of the lattice. Although tungsten is used to fill the joint central voids in this embodiment of the invention, one of ordinary skill in the art will readily appreciate that any standard material that is much denser than water can be used to fill the joint central voids. For example, in other embodiments of the invention, the tungsten is exchanged with another dense material such as steel, gold, or lead.

In some embodiments of the invention, one or more components of the unit cell are manufactured out of a standard piezoelectric ceramic, such as lead zirconate titanate, or a standard electro- or magneto-rheologic material, such as a standard polymer composite containing ferromagnetic particles, in order to introduce an active forcing component that generates vibro-acoustic fields within the lattice through the application of an electric or magnetic field.

In some embodiments of the invention, the components of the unit cell are cast within a standard mold using a standard casting process. The casting process and mold components depend on the application. In embodiments that utilize high-temperature metal casting, for example, illustrative casting materials include standard metal alloys, such as gallium-indium alloys and brass. In embodiments that utilize the lower-temperature casting, of standard polymers, for example, illustrative casting materials include polycarbonate and polydimethylsiloxane. In some embodiments of the invention, the pre-manufactured joint walls and connecting arms act as molds for the casting of materials into the joint central voids and gaps. In other embodiments of the invention, the pre-manufactured joint central voids and gaps act as molds for the casting of materials into the joint walls and connecting arms.

In one or more embodiments of the invention, the components of the unit cell are manufactured out of standard foams that have a high porosity. In some embodiments of the invention, the base material of the foams includes standard polymers, such as polystyrene. In other embodiments of the invention, the base material of the foams includes standard metals, such as aluminum or copper.

In one or more embodiments of the invention, the components of the unit cell are etched out of a standard semiconducting material using a standard etching process. For example, standard semiconducting wafer etching is used to produce lattice structures consistent with embodiments of the invention. Examples of such semiconducting materials include silicon, gallium arsenide, or gallium nitride. For example, in an illustrative embodiment of the invention where the joint walls and connecting arms are etched at the surface of a semiconducting wafer, the joint central voids and gaps are then filled with other materials through standard mask and deposition techniques. Illustrative semiconductor applications include the production of delay lines that function using surface acoustic waves or other coupled elastic waves.

In one or more embodiments of the invention, the lattice unit cells are manufactured with a characteristic scale that is important to the propagation of phonons and the transport of heat through a medium. In such embodiments of the invention, the unit cell geometries are optimized for the purpose of controlling thermal or phonon transport through the elastic material.

In one or more embodiments of the invention, the materials making up the unit cell components are standard composite materials such as standard carbon fiber/epoxy or standard nylon fiber/epoxy composites. In other embodiments, the materials making up the unit cell components are standard rubbers such as butyl rubber or natural rubber.

In one or more embodiments of the invention where multiple gaps are present, the materials filling the gaps 104 and 106 are not the same materials; in other words, gap 104 and gap 106 have respective materials.

In one or more embodiments of the invention, the plurality of unit cells 100 produce band gaps at certain vibro-acoustic oscillation frequencies that suppress the propagation of vibro-acoustic waves. A "band gap" is defined herein as a band of frequencies where there are no modes of propagating vibro-acoustic fields in the lattice. In such embodiments of the invention, the material composition of the joint central voids 114 and/or the location of the connecting arms 116, 118 determine the range of vibro-acoustic frequencies at which these band gaps occur. In some embodiments of the invention, the range in frequency of the band gaps is determined solely by selecting the material composition of the joint central voids 114.

In one or more embodiments of the invention, the plurality of unit cells 100 produce a band of propagating vibro-acoustic oscillation frequencies where the lattice vibrates at only one vibrational mode. In such embodiments of the invention, the single vibrational mode has a polarization defined by compressional, shear, or a mix of compressional and shear motion. The material composition of the joint central voids 114 and the location of connecting arms 116, 118 is determined in order to select in turn the range of vibro-acoustic frequencies at which these single vibrational modes occur. An illustrative embodiment of the invention that produces single modes of propagation is an anti-tetrachiral lattice where the joint walls 112 and connecting arms 116, 118 of the unit cell 102 are composed of acrylonitrile butadiene styrene. In an embodiment of the invention where the joint central voids 114 are filled with air, the band of single-mode propagation is broken up by complete band gaps. In an embodiment of the invention where the joint wall 112 is selected to be thicker, thereby filling in the joint central void 114 with acrylonitrile butadiene styrene, the band gaps forms at higher frequencies, while the bands of single-mode propagation re-forms at lower frequencies. In an embodiment of the invention where the connecting arms 226, 228 of the unit cell 204 are selected to be between the center and the edge of the joint wall 112, the band of single-mode propagation forms at a higher frequency compared to an embodiment of the invention wherein a unit cell 102 includes connecting arms 116, 118 at the edge of the joint wall.

Figure 3D:
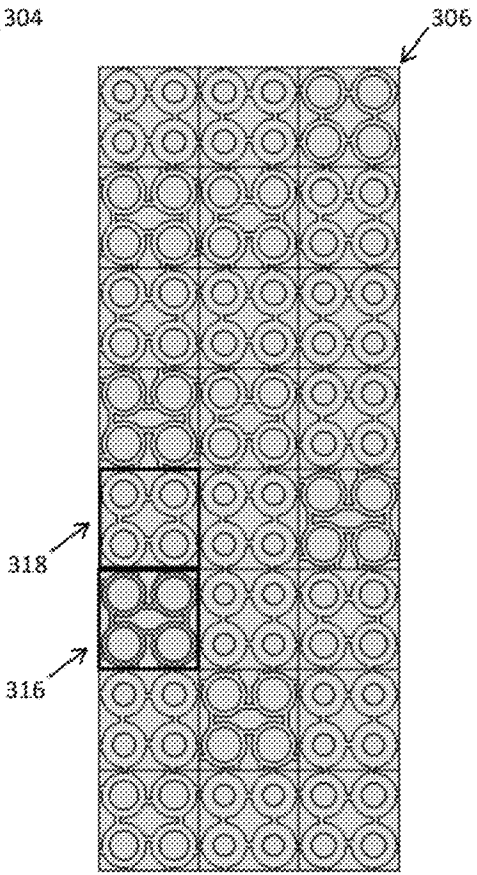
FIG. 3D is a schematic diagram of a plurality of unit cells having underlying unit cell geometries that are randomly configured in accordance with the present invention.

Another illustrative goal of this invention is to create a material that has a spatially heterogeneous distribution of vibro-acoustic wave speeds. In accordance with some aspects of the present invention, FIGS. 3A-3D illustrate alternate embodiments of the invention, showing standard anisotropic and standard disordered heterogeneous elastic materials with a plurality of unit cells 300, 302, 304, 306. The term "heterogeneous elastic material" as used for the purpose of the instant specification refers to an elastic material with a plurality of unit cells, but where at least one of the unit cells is not identical to the others. Each unit cell 102, 312, 314, 316, 318 does not necessarily have the same geometry as its adjacent unit cells. In some embodiments of the invention, such as that shown in FIG. 3A, the unit cells 312 have functionally-graded geometries, wherein the unit cells have one or more geometric features that differ from cell to cell in at least one spatial direction. Alternatively, in other embodiments of the invention, the unit cells 312 have functionally-graded geometries, wherein the unit cells have one or more geometric features that differ from plurality of unit cells to plurality of unit cells in at least one spatial direction. Alternatively, in other embodiments of the invention, the unit cells 312 have functionally-graded geometries, wherein the unit cells have one or more geometric features that differ between interfaces, i.e., between layers of like unit cells, in at least one spatial direction. In some embodiments of the invention, such as that shown in FIG. 3B, the unit cells 102, 314 alternate back and forth between at least two different unit cell geometries in at least one spatial direction. The geometries of such embodiments are often referred to as a "superlattice" in the literature and for the purpose of this specification. The lattices shown in FIGS. 3A and 3B are described as "multi-component lattices," which for the purpose of this specification are lattices that have more than one type of unit cell but that repeat in a regular order in at least one spatial direction.

Figure 3C:
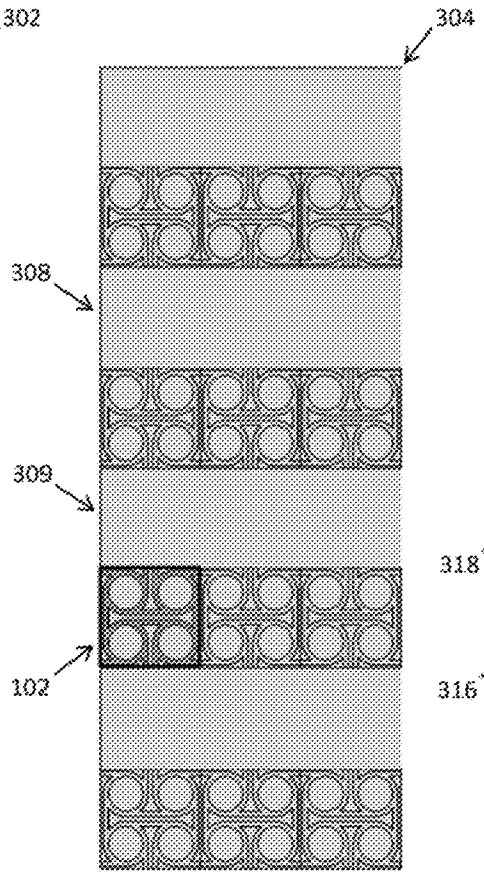
FIG. 3C is a schematic diagram of a plurality of unit cells that alternate their composition every other cell with a material that is either homogenous or heterogenous in accordance with the present invention.
Figure 3B:
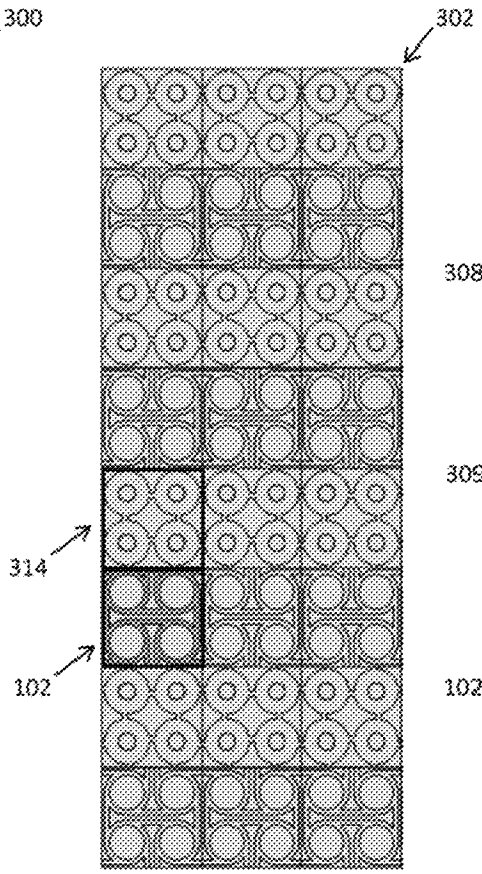
FIG. 3B is a schematic diagram of a plurality of unit cells that alternate their geometry every other cell to form a superlattice in accordance with the present invention.
Figure 3A:
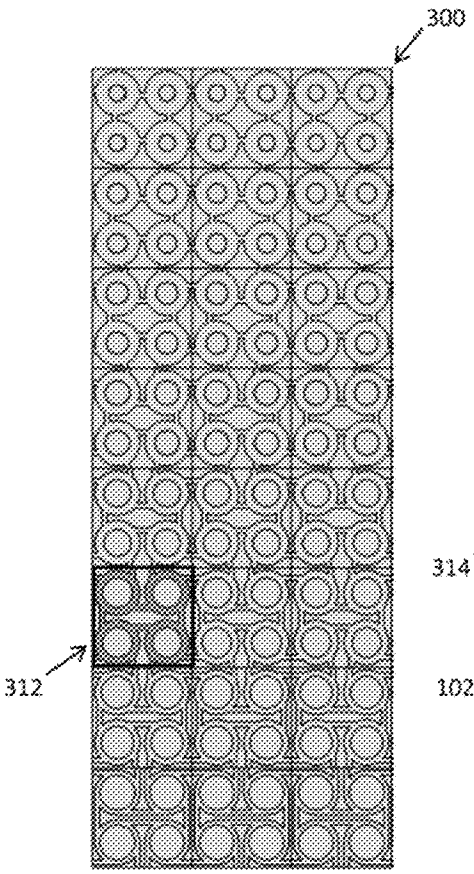
FIG. 3A is a schematic diagram of a plurality of unit cells that are functionally-graded in the vertical direction in accordance with the present invention.

In one or more embodiments of the invention, such as that shown in FIG. 3C, the unit cells 102 alternate with other types of material geometries 308, 309 in at least one spatial direction. The alternate material geometries 308 and 309 are a heterogeneous geometry or a homogeneous geometry, and need not be composed of the same material. The term "homogeneous geometry" refers herein to a geometry composed of a single material. The term "heterogeneous geometry" refers herein to a geometry composed of more than one material and/or geometry. Heterogeneous geometries can be disordered heterogeneous geometries or lattice geometries. The term "disordered heterogeneous geometry" refers herein to a geometry composed of multiple component geometries that do not repeat in space with a regular order. The term "lattice geometry" refers herein to a geometry with an underlying unit cell that repeats in space with a regular order. Disordered heterogeneous geometries are either lattice-free, wherein there are no lattice geometries found in any component geometries, or disordered heterogeneous geometries, which contain component geometries that form a lattice locally, but that do not repeat in space beyond a confined region.

In one or more embodiments of the invention, such as that shown in FIG. 3D, the unit cells 316, 318 have geometries that do not repeat in a regular order and have randomized configurations, but nevertheless preserve an underlying regular spatial repetition. In one or more embodiments of the invention, the rotational orientation of each unit cell 102, 312, 314, 316, 318 is not preserved between adjacent unit cells, causing functionally graded or random rotational orientations across the entire plurality of unit cells 300, 302, 304, 306.

Figure 4A:
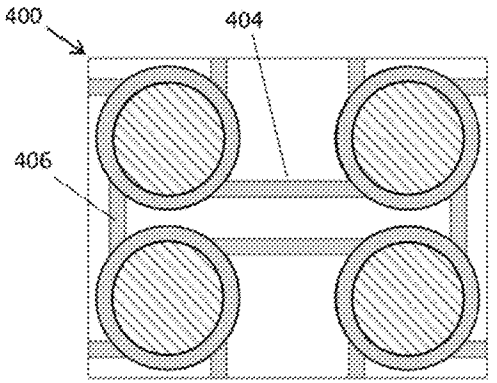
FIG. 4A is a schematic diagram of an anisotropic unit cell with connecting arms lengthened in one spatial direction in accordance with the present invention.
Figure 4B:
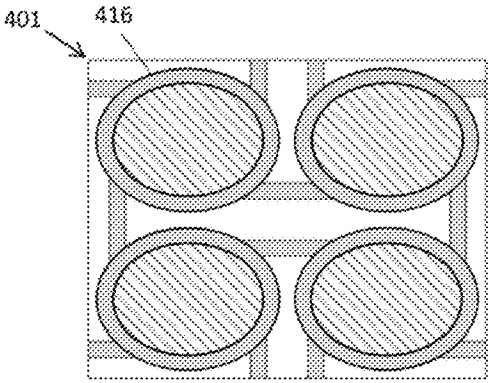
FIG. 4B is a schematic diagram of an anisotropic unit cell with joint walls and joint central voids extended in one spatial direction in accordance with the present invention.
Figure 4C:
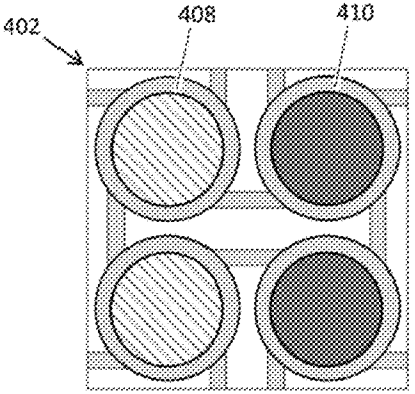
FIG. 4C is a schematic diagram of an anisotropic unit cell with different materials filling adjacent joint central voids in accordance with the present invention.
Figure 4D:
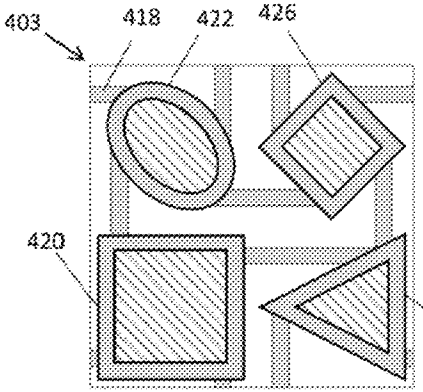
FIG. 4D is a schematic diagram of an anisotropic unit cell with joint walls and joint central voids composed of different geometric shapes in accordance with the present invention.

In accordance with some aspects of the present invention, FIGS. 4A-4H illustrates alternate embodiments of the unit cells that make up the lattice structures depicted in FIGS. 1A-3. In one or more embodiments of the invention, such as shown in FIG. 4A, the connecting arms 404 of the unit cell 400 are lengthened in at least one direction when compared to connecting arms 406 in orthogonal directions in order to produce an anisotropic geometry, and thereby produce anisotropic vibro-acoustic material properties. In one or more embodiments of the invention, such as shown in FIG. 4B, the size and geometry of the elastic joint walls 416 of the unit cell 401 are extended or contracted in at least one direction compared to other orthogonal directions, thereby creating anisotropic vibro-acoustic material properties. In one or more embodiments, such as shown in FIG. 4C, the material composition of one joint central void 408 of the unit cell 402 differs from that of at least one adjacent joint central void 410, thereby creating anisotropic vibro-acoustic material properties. In one or more embodiments of the invention, such as shown in FIG. 4D, the geometric shape of the elastic joint walls 420, 422, 424, 426 are selected to impose alternative symmetries and asymmetries to the unit cell 403. In such embodiments of the invention, the geometry of one particular elastic joint wall 420 is the same or different from the joint walls of adjacent sub-units. In one or more embodiments of the invention, such as shown in FIG. 4D, the elastic joint wall includes a standard shape such as a standard rectangle 420, a standard oval 422, a standard triangle 424, or a standard diamond 426. In one or more embodiments of the invention, the axes of symmetry of the geometry defining the elastic joint walls 420, 422, 424, 426 is rotated with respect to the direction of extension of the connecting arms 418, which is exemplified by the rotated oval 422 in the upper left of the unit cell in FIG. 4D.

In one or more embodiments of the invention, the anisotropy introduced by appropriately selecting the geometry of the unit cells 400, 401, 402, 403 in at least one principal direction creates directional band gaps in at least one principal direction compared to other orthogonal directions. In some embodiments of the invention, the directional band gap creates a hyperbolic band structure over a range of vibro-acoustic oscillation frequencies. In such embodiments of the invention, the range of frequencies that feature the directional and/or hyperbolic bands are determined by appropriate selection of the geometric and material composition of the connecting arms 404, 406, 418, the joint walls 416, 420, 422, 424, 426, and the joint central voids 408 and 410.

Figure 4E:
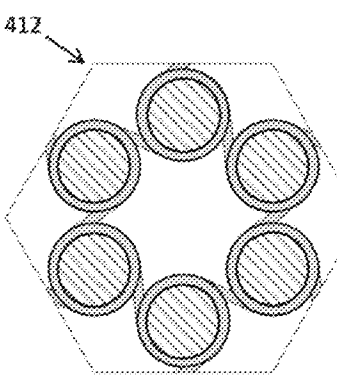
FIG. 4E is a schematic diagram of a trichiral unit cell in accordance with the present invention.
Figure 4F:
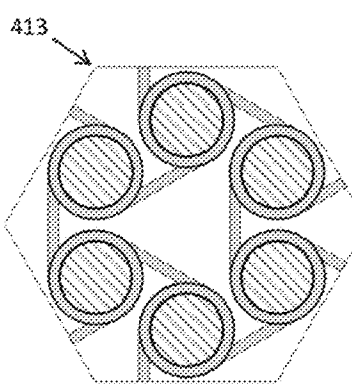
FIG. 4F is a schematic diagram of an anti-trichiral unit cell in accordance with the present invention.
Figure 4G:
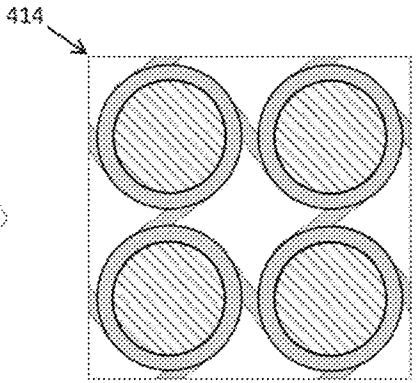
FIG. 4G is a schematic diagram of a tetrachiral unit cell in accordance with the present invention.
Figure 4H:
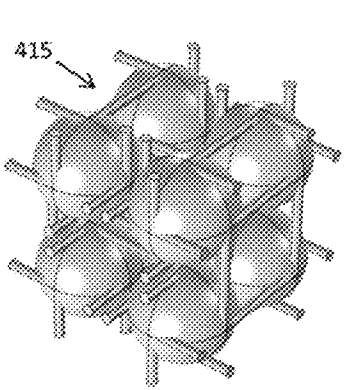
FIG. 4H is a schematic diagram of a three-dimensional anti-tetrachiral unit cell in accordance with the present invention.

In one or more embodiments of the invention, such as shown in FIGS. 4E, 4F, and 4G, the lattice unit cell is configured as a trichiral symmetry 412, an anti-trichiral symmetry 413, or a tetrachiral symmetry respectively 414. In one or more embodiments of the invention, the unit cells such as shown in FIGS. 1A-3 and 4A-G are extruded out of the plane to form a three-dimensional honeycomb-like lattice. In other embodiments of the invention, such as a three-dimensional anti-tetrachiral unit cell shown in FIG. 411, the lattice unit cell 415 is the three-dimensional embodiment of any unit cell consistent with this specification. In embodiments of the invention, the unit cells 412, 413, 414, 415 take on any geometric modifications consistent with this disclosure.

In one or more embodiments of the instant invention, the vibro-acoustic bands approach a Brillouin zone boundary with a linear slope. In such embodiments of the invention, the frequency at which the vibro-acoustic band crosses the Brillouin zone boundary is selected by selecting the geometric and/or material composition of the connecting arms, the joint walls, and/or the joint central voids. For example, when compared with the selection of locating the connecting arms 116, 118 at the edge of the joint walls 112 in FIG. 2A, if instead the connecting arms 226, 228 are located between the edge and the center of the joint walls 112, the dynamic composite stiffness of the unit cell increases, which in turn increases the frequency at which a linear crossing occurs. In another illustrative embodiment of the invention, the frequency at which a linearly-sloping band crosses the Brillouin zone boundary is selected by selecting the scale of the unit cell.

In one or more embodiments of the invention where different unit cells are coupled together, for example as shown in FIGS. 3A-3D, a subset of such embodiments requires a modification of the joining regions where the unit cells 102, 312, 314, 316, 318 are coupled to other adjacent unit cells. For the illustrative joining region 500 shown in FIG. 5A, no modification of the joining region is required to couple two identical unit cells 102 because the connecting arm 521 to the left of the joining region meets the connecting arm 522 to the right of the joining region in the same spatial location. For the illustrative joining region 510 shown in FIG. 5B, some embodiments of the invention include joining region inclusions 503, 505 to couple the connecting arm 521 to the left of the joining region with the connecting arm 532 to the right of the joining region because the two connecting arms 521, 532 do not meet in the same spatial location. Such a joining region inclusion is, for example, important for embodiments of the invention wherein the material filling the gaps 534, 536 around the connecting arms has a substantially different vibro-acoustic impedance when compared with the material composition of the connecting arms. For example, for an embodiment of the invention where the connecting arms 521, 532 include a standard metal and the gaps 534, 536 are filled with air, there is significantly degraded vibro-acoustic coupling between the connecting arms and the gap because of the high vibro-acoustic impedance contrast between metals and air. In such embodiments, the joining region inclusions 503, 505 are selected to be composed of an appropriate standard material, such as the same metal, to provide improved coupling between adjacent unit cells.

Figures 5A, 5B, 5C, 5D, 5E, 5F, 5G:
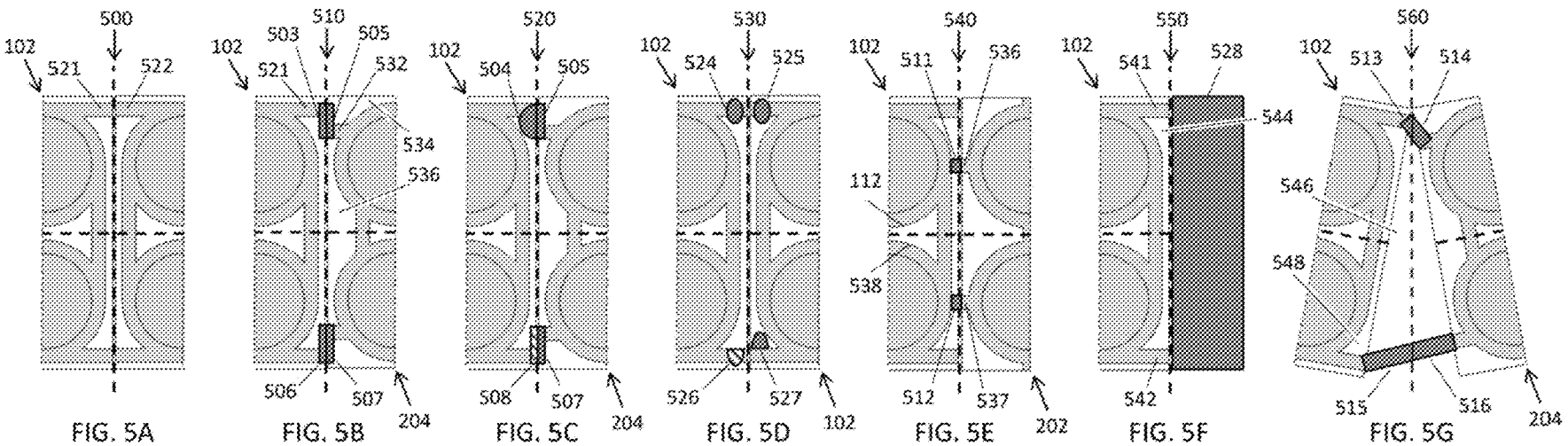
FIG. 5A is a schematic diagram of the joining region between two adjacent anti-tetrachiral unit cells in the absence of joining region inclusions in accordance with the present invention.
FIG. 5B is a schematic diagram of the joining region between two adjacent anti-tetrachiral unit cells having identical joining region inclusions located at the joining interface in accordance with the present invention.
FIG. 5C is a schematic diagram of the joining region between two adjacent anti-tetrachiral unit cells having joining region inclusions located at the joining interface that are different in geometry and composition in accordance with the present invention.
FIG. 5D is a schematic diagram of the joining region between two adjacent anti-tetrachiral unit cells having inclusions set back from the joining interface in accordance with the present invention.
FIG. 5E is a schematic diagram of the joining region between two adjacent anti-tetrachiral unit cells where joining region inclusions are used to directly connect a joint wall on one side of the joining region to an arm on the other side in accordance with the present invention.
FIG. 5F is a schematic diagram of the joining region between an anti-tetrachiral unit cell a different homogenous or heterogeneous material in accordance with the present invention.
FIG. 5G is a schematic diagram of the joining region between two adjacent anti-tetrachiral unit cells that have rotated orientations and have asymmetric joining region inclusions connecting the respective adjacent unit cell arms in accordance with the present invention.

In one or more embodiments of the invention, such as shown in FIG. 5B, the joining region inclusions 503, 505, 506, 507 have the same geometry and material composition, and are symmetric about the joining region 510. In other embodiments of the invention, the joining region inclusions 504, 505, 507, 508 do not have the same geometry, material composition, and/or symmetry of location about the unit cell. For the illustrative example shown in FIG. 5C, the joining region inclusion 504 is selected to have a different geometry from the inclusion 505, and the joining region inclusion 508 is selected to have a different material composition from the inclusion 507.

In one or more embodiments of the invention, such as shown in FIG. 5D, the joining region inclusions 524, 525, 526, 527 are located at a position offset from the joining region location 530. When offset by some distance from the joining region 530, some embodiments of the invention will have joining region inclusions 524, 525 that are selected to have the same geometry, material composition, and symmetry. Other embodiments of the invention will have the joining region inclusions 526, 527 that are selected to have different geometry, material composition, and/or symmetry.

In one or more embodiments of the invention, such as shown in FIG. 5E, the connecting arms 536, 537 of a single unit cell 202 are connected directly to the joint walls 112, 538 of an adjacent unit cell 102 using joining region inclusions 511, 512.

In one or more embodiments of the invention, such as shown in FIG. 5F, a unit cell 102 is coupled to a homogenous or heterogenous geometry 528 by attaching the connecting arms 541, 542 to the geometry 528 at the joining region 550. In one or more embodiments of the invention, the homogenous or heterogenous geometry 528 fills the gaps 544 on the other side of the joining region 550.

In one or more embodiments of the invention, such as shown in FIG. 5G, where adjacent unit cells 102 and 204 have a rotated orientation with respect to one-another, joining region inclusions 513, 514, 515, 516 are used to couple the connecting arms of these two unit cells together. The joining region inclusions 513, 514, 515, 516 are extended to bridge the additional space 546 introduced by the rotated orientations. The additional space 546 is filled, for example, with any material consistent with this disclosure, or is evacuated. In some embodiments of the invention, the material filling the additional space 546 is selected to be the same as the material selected to fill the gaps 548; in other embodiments of the invention, the materials filling the additional space and gaps differ from each other.

Figure 6C:
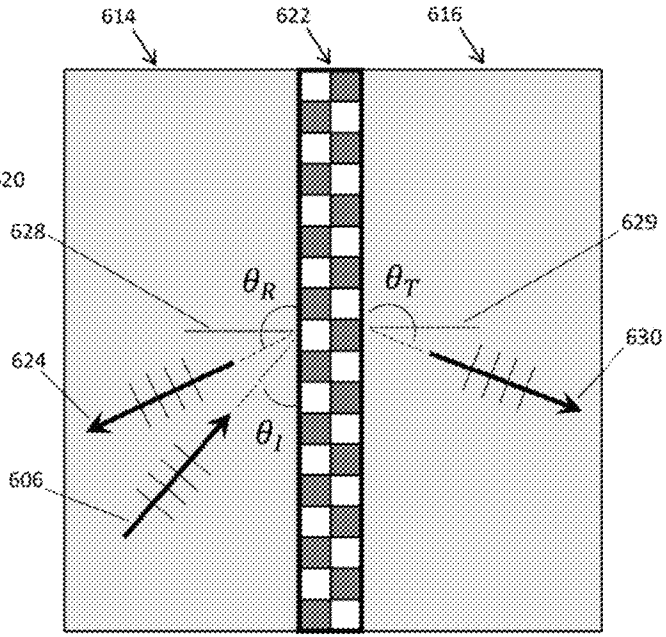
FIG. 6C is a schematic diagram illustrating an aperture featuring negative refraction that alters vibro-acoustic propagating fields that are reflected from and/or transmitted through said aperture in accordance with the present invention.
Figure 6B:
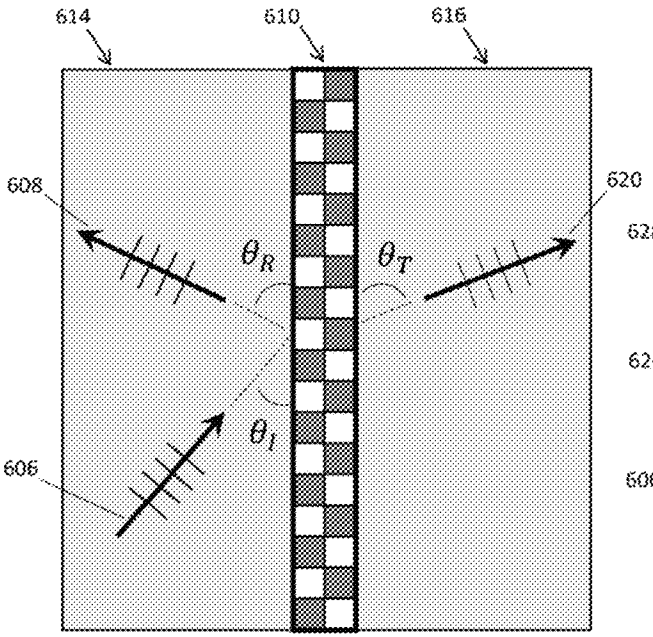
FIG. 6B is a schematic diagram illustrating an aperture that alters vibro-acoustic propagating fields that are reflected from and/or transmitted through said aperture in accordance with the present invention.
Figure 6A:
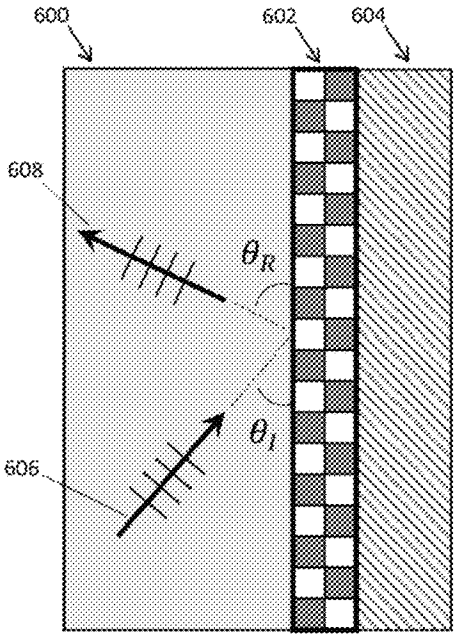
FIG. 6A is a schematic diagram illustrating an aperture that alters vibro-acoustic propagating fields that are reflected from a surface in accordance with the present invention.

Another illustrative goal of this invention is to create a wave-steering material that can alter the propagation of vibro-acoustic fields within an exterior medium as the field propagates away from its source. In order to alter the propagation of such fields, the vibro-acoustic fields must be coupled into the wave-steering material. In one or more embodiments of the invention, such as depicted in FIGS. 6A-6C, exterior media 600, 614, 616 are coupled to lattices 602, 610, 622. In one or more embodiments of the invention, such as shown in FIG. 6A, the lattice 602 is resting on a surface 604 that primarily reflects incoming vibro-acoustic propagating fields 606. In such embodiments of the invention, the exterior media 600, 614, 616 include standard heterogeneous media or standard homogeneous media, and include acoustic or elastic media. In such embodiments of the invention, the lattices 602, 610, 622 include a plurality of unit cells with composition that is consistent with the instant invention as described herein. A purpose of the embodiment depicted in FIG. 6A is to use the vibro-acoustic coupling with the lattice 602 to preserve or modify the outgoing reflected vibro-acoustic propagating field 608. In one or more embodiments of the invention, the exterior medium 600 is water.

In some embodiments of the invention, the lattice 602 has a functionally-graded vibro-acoustic wave speed such that the out-going vibro-acoustic field 608 propagates away from the lattice at a different reflection angel $\theta_R$ than the incident angle $\theta_I$ of the incident vibro-acoustic field 606. In some embodiments of the invention, the out-going vibro-acoustic field 608 is focused and intensified within a finite spatial region within the exterior medium 600. In some embodiments of the invention, the amplitude of the out-going vibro-acoustic field 608 is minimized due to finite absorption in the lattice 602. In some embodiments of the invention, the out-going vibro-acoustic field 608 is dispersed in random directions. In other embodiments of the invention, the out-going vibro-acoustic field 608 mimics the radiated spatial and temporal vibro-acoustic field pattern that would have been generated by at least one vibro-acoustic source situated on the reflecting surface 604.

In one or more embodiments of the invention, such as depicted in FIG. 6B, the lattice 610 transfers an incident vibro-acoustic propagating field 606 from a source medium 614 to a destination medium 616. In some embodiments of the invention, the source medium 614 and destination medium 616 are composed of the same standard material; in other embodiments of the invention, the source medium and the destination medium are composed of different standard materials. A purpose of the embodiment of the invention depicted in FIG. 6B is to use the vibro-acoustic coupling with the lattice 610 to preserve or modify both the vibro-acoustic field 608 reflected from the lattice and the vibro-acoustic field 620 transmitted through the lattice. In some embodiments of the invention, the lattice 610 has a functionally-graded vibro-acoustic wave speed such that at least one of the out-going vibro-acoustic fields reflected 608 and transmitted 620 by the lattice propagates with a different reflection angle $\theta_R$ and transmission angle $\theta_T$, respectively, compared with that of the incident angle $\theta_I$. In one or more embodiments of the invention, at least one of the out-going vibro-acoustic fields reflected 608 and transmitted 620 by the lattice is focused and intensified within a finite spatial region within at least one of the exterior media 614 and 616. In some embodiments of the invention, the amplitude of at least one of the out-going vibro-acoustic fields both reflected 608 and transmitted 620 by the lattice 610 is minimized due to finite absorption in the lattice. In other embodiments of the invention, at least one of the out-going vibro-acoustic fields reflected 608 and transmitted 620 by the lattice is dispersed in random directions.

In one or more embodiments of the invention, the amplitude of the reflected vibro-acoustic field 608 is minimized due to an approximate vibro-acoustic impedance match between the lattice 610 and the exterior media 614 and 616. In other embodiments of the invention where the vibro-acoustic impedance of the source medium 614 differs from that of the destination medium 616, the amplitude of the reflected vibro-acoustic field 608 is minimized using a functionally-graded vibro-acoustic impedance in the lattice 610.

In one or more embodiments of the invention, the lattices 602 and 610 are used to exchange the primary polarization of the incident vibro-acoustic wave 606. In such embodiments of the invention, the lattices 602 and 610 transform compressional polarization to shear polarization or transform the shear polarization to compressional polarization.

In one or more embodiments of the invention, the source media 600, 614 and destination medium 616 are water. In other embodiments of the invention, the source medium 614 is a standard elastic material that contains a standard vibro-acoustic source, while the destination medium 616 is the body of an animal or the body of a human. In other embodiments of the invention, the source medium 614 is a standard elastic material that contains a standard vibro-acoustic source, while the destination medium 616 is a standard elastic medium that is the target of non-destructive testing.

In one or more embodiments of the invention, the thickness of the lattices 602 and 610 is much smaller than the vibro-acoustic wavelength of propagation in at least one of the source media 600, 614 and the destination medium 616. In such embodiments of the invention, the lattices 602 and 610 are defined as "metasurfaces" for the purpose of the instant specification. In one or more embodiments of the invention, the purpose of coupling to such metasurface lattices 602 and 610 is to create vibro-acoustic resonances in the metasurface lattices. In some embodiments of the invention, the lattices 602 and 610 delay the phase of a propagating vibro-acoustic field over a sub-wavelength path length by up to and including 360 degrees.

In one or more embodiments of the invention, the lattices 602 and 610 are used to focus a vibro-acoustic field into a spatial region that is sub-wavelength in size and smaller than the virbo-acoustic diffraction limit. Such an embodiment functions as a "superlens" for the purpose of the instant specification as that term is used in the relevant literature. When the sub-wavelength focusing occurs due to an interaction with a hyperbolic band structure, such an embodiment functions as a "hyperlens" for the purpose of the instant specification as that term is used in the relevant literature. In such embodiments of the invention, it is possible to focus the near-field components of a vibro-acoustic wave.

In one or more embodiments of the invention, such as that shown in FIG. 5C, the lattice 622 creates negative refraction and/or backward reflection. Backward reflection occurs when the out-going, reflected vibro-acoustic field 624 propagates in a direction that is back toward the incident field 606 on the same side of the line 628 normal to the surface interfacing with the lattice 622. Negative refraction occurs when the out-going, transmitted vibro-acoustic field 630 propagates away in a direction that is on the same side of the line 629 normal to the surface interfacing with the lattice 622.

Figure 7B:
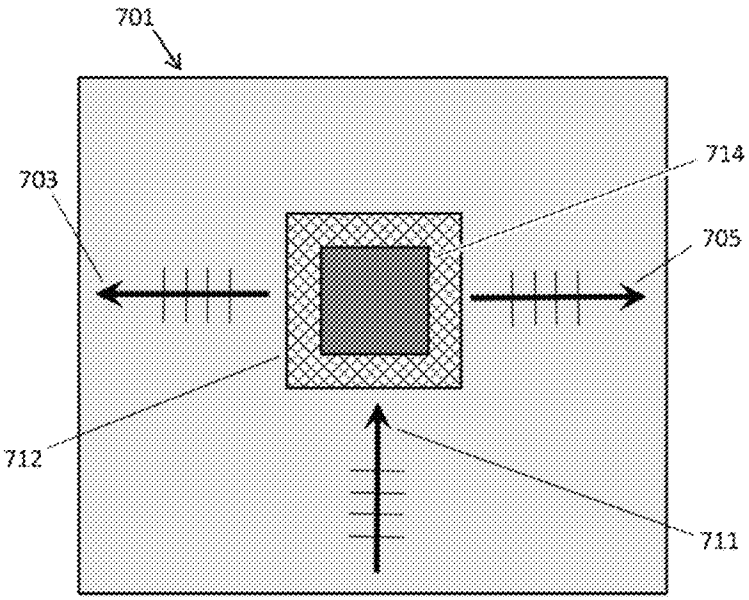
FIG. 7A is a schematic diagram illustrating an aperture that alters vibro-acoustic propagating fields that are incident on and/or emanating from a curved vibro-acoustic source and/or sensor in accordance with the present invention; and, FIG. 7B is a schematic diagram illustrating an aperture that alters vibro-acoustic propagating fields that are incident on and/or emanating from a directionally-dependent vibro-acoustic source and/or sensor in accordance with the present invention.
Figure 7A:
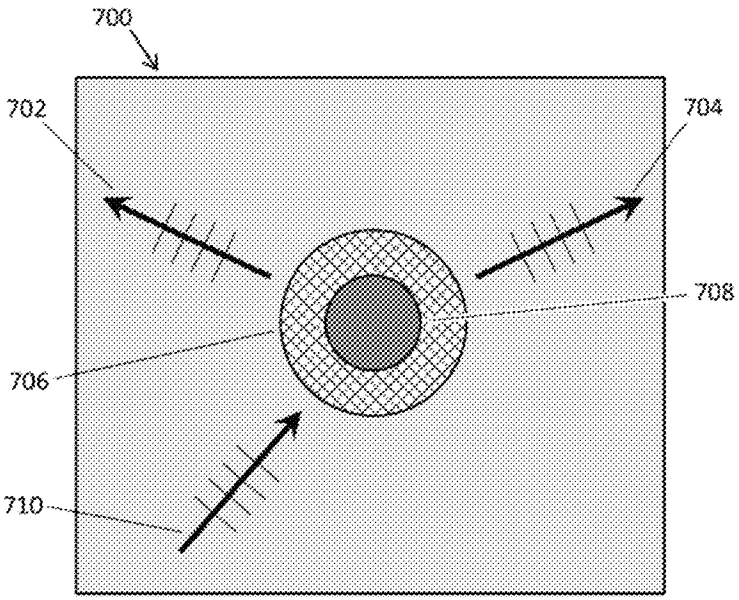

In one or more embodiments of the invention, such as that shown in FIGS. 7A-7B, the lattices 706, 712 are wrapped around vibro-acoustic field sources and/or sensors 708, 714, which are situated in exterior media 700, 701. The purpose of such embodiments of the invention is to preserve or modify the spatial and/or temporal content of the propagating vibro-acoustic fields as they leave the source or are received by the sensor. One of ordinary skill in the art will readily appreciate that a component that can be used as a vibro-acoustic field source can also be used to sense such fields. In such embodiments of the invention, the exterior media 700, 701 include standard heterogeneous or standard homogeneous media, and are standard acoustic or standard elastic media. In such embodiments of the invention, the lattices 706, 712 have a plurality of unit cells with composition that is consistent with the instant invention as described herein. In some embodiments of the invention, the vibro-acoustic field source and/or sensor 708, 714 include a group of multiple standard sources and/or standard sensors.

In one or more embodiments of the invention, such as that shown in FIG. 7A, the vibro-acoustic field source 708 propagates vibro-acoustic fields 702, 704 outward in an omni-directional pattern with spherical or cylindrical symmetry. In such embodiments of the invention, the lattice 706 maintains or changes the temporal and/or spatial content of the propagating vibro-acoustic fields 702, 704 such that the spherical or cylindrical symmetry is preserved or is broken. Similarly, when the vibro-acoustic field source is used to sense incoming vibro-acoustic fields 710, the spherical or cylindrical symmetry of the sensor's spatial-temporal sensitivity is preserved or broken.

In one or more embodiments of the invention, such as that shown in FIG. 7B, the vibro-acoustic field source 714 propagates vibro-acoustic fields 703, 705 outward in a directed beam pattern. In such embodiments of the invention, the lattice 712 maintains or changes the temporal and/or spatial content of the propagating vibro-acoustic fields 703, 705 such that the beam shape and/or its directivity is preserved or is altered. Similarly, when the vibro-acoustic field source is used to sense incoming vibro-acoustic fields 711, the sensor's spatial-temporal sensitivity is preserved or altered.

In one or more embodiments of the invention, the lattices 706 and 712 are used to exchange the primary polarization of the outgoing vibro-acoustic fields 702, 703, 704, 705. In such embodiments of the invention, the lattices 706, 712 transform compressional polarization to shear polarization or transform the shear polarization to compressional polarization. A transformation to shear polarization is possible when the exterior media 700, 701 are standard elastic solids. Similarly, in other embodiments of the invention, the lattices 706 and 712 are used to exchange the primary polarization of the incoming vibro-acoustic fields 710, 711. In such embodiments of the invention, the exterior media 700, 701 are standard fluids or standard elastic solids.

Although a particular feature of the disclosure may have been illustrated and/or described with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising".

This written description sets forth the best mode of the invention and provides examples to describe the invention and to enable a person of ordinary skill in the art to make and use the invention. This written description does not limit the invention to the precise terms set forth. Thus, while the invention has been described in detail with reference to the examples set forth above, those of ordinary skill in the art may effect alterations, modifications and variations to the examples without departing from the scope of the invention.

These and other implementations are within the scope of the following claims.

What is claimed as new and desired to be protected by Letters Patent of the United States is:

1. A device for use in a medium comprising a medium vibro-acoustic impedance, the device comprising:

an elastic material comprising a plurality of unit cells, said plurality of unit cells comprising a first unit cell, said first unit cell comprising:

a first unit-cell joint comprising a first unit-cell joint wall defining a first joint central void;

a first unit-cell joint inclusion located in the first joint central void; and at least two first unit-cell arms connected to and extending away from said first unit-cell joint;

wherein said elastic material comprises an elastic-material vibro-acoustic impedance, said elastic-material vibro-acoustic impedance and the medium vibro-acoustic impedance being sufficiently vibro-acoustically impedance-matched to couple time-varying, propagating vibro-acoustic fields between said elastic material and the medium, wherein said first joint wall comprises at least one of a first semiconductor, a first metal, a first metal alloy, a first polymer, a first foam, a first gel, a first rubber, a first elastic composite, and a first ceramic, wherein said first unit-cell joint inclusion comprises at least one of a second semiconductor, a second metal, a second metal alloy, a second polymer, a second foam, a second gel, a second rubber, a second elastic composite, a second ceramic, and a first unit-cell joint inclusion fluid, wherein said at least two first unit-cell arms comprise at least one of a third semiconductor, a third metal, a third metal alloy, a third polymer, a third foam, a third gel, a third rubber, a third elastic composite, and a third ceramic.

2. The device according to claim 1, wherein the medium comprises one of water and oil.

3. The device according to claim 1, wherein at least one of said first semiconductor, said second semiconductor, and said third semiconductor comprises one of silicon and gallium nitride;

wherein at least one of said first metal, said second metal, and said third metal comprises one of tungsten, gold, and steel, wherein at least one of said first metal alloy, said second metal alloy, and said third metal alloy comprises one of a gallium-indium alloy and brass, wherein at least one of said first polymer, said second polymer, and said third polymer comprises one of polydimethylsiloxane and acrylonitrile butadiene styrene, wherein at least one of said first ceramic, said second ceramic, and said third ceramic comprises one of alumina and lead zirconate titanate, and wherein at least one of said first foam, said second foam, and said third foam comprises one of aluminum foam and polystyrene foam, wherein at least one of said first gel, said second gel, and said third gel comprises one of hydrogel and organogel, wherein at least one of said first rubber, said second rubber, and said third rubber comprises one of butyl rubber and natural rubber, wherein at least one of said first elastic composite, said second elastic composite, said third elastic composite comprises one of carbon fiber/epoxy composite and polymer/ferromagnetic particle composite, wherein said fluid comprises of one of water and air.

4. The device according to claim 1, wherein said elastic material comprises one of at least one disordered heterogeneous geometry and at least one lattice geometry.

5. The device according to claim 4, wherein said at least one lattice geometry comprises one of an anti-chiral lattice geometry and a chiral lattice geometry.

6. The device according to claim 5, wherein said elastic material comprising said chiral lattice geometry comprises a first acousto-elastic metamaterial;

wherein said elastic material comprising said anti-chiral lattice geometry comprises at least one of an auxetic material and a second acousto-elastic metamaterial.

7. The device according to claim 5, wherein said anti-chiral lattice geometry comprises one of an anti-trichiral lattice geometry and an anti-tetrachiral lattice geometry, wherein said chiral lattice geometry comprises one of a trichiral lattice geometry and a tetrachiral lattice geometry.

8. The device according to claim 4, wherein said at least one disordered heterogeneous geometry comprises a plurality of lattice-free geometries, wherein said at least one lattice geometry comprises a plurality of lattice geometries.

9. The device according to claim 8, wherein said elastic material comprises a plurality of joining regions interconnecting said at least one of a plurality of lattice-free geometries and a plurality of lattice geometries.

10. The device according to claim 9, wherein said plurality of joining regions comprises one of at least two same joining region inclusions, at least two different joining region inclusions, and said plurality of joining regions being free of said at least two same joining region inclusions and said at least two different joining region inclusions.

11. The device according to claim 1, wherein said plurality of unit cells comprises a second unit cell, said second unit cell comprising:

a second unit-cell joint comprising a second unit-cell joint wall defining a second joint central void;

a second unit-cell joint inclusion located in the second joint central void; and at least two second unit-cell arms connected to and extending away from said second unit-cell joint;

wherein said first unit cell and said second unit cell define at least one gap and comprise one of a gap material and a vacuum in the at least one gap.

12. The device according to claim 11, wherein said gap material comprises at least one of a gap fluid and an elastic gap solid, wherein said gap fluid comprises one of air and water;

wherein said elastic gap solid comprises a gap solid bulk modulus, a gap solid shear modulus of elasticity, and a gap solid density sufficient for at least partial propagation of vibro-acoustic waves along said first unit-cell arms.

13. The device according to claim 11, wherein said first unit-cell joint comprises a plurality of tangent points, at least one arm of said at least two first unit-cell arms extending tangentially away from a respective tangent point of said plurality of tangent points and connecting to said second unit-cell joint.

14. The device according to claim 11, wherein said first unit-cell joint comprises a plurality of tangent points, at least one first unit-cell arm of said at least two first unit-cell arms extending away offset from a respective tangent point of said plurality of tangent points and connecting to said second unit-cell joint.

15. The device according to claim 1, further comprising:

a phase-modulating aperture comprising said elastic material.

16. The device according to claim 15, wherein said phase-modulating aperture comprises one of an acousto-elastic superlens and an acousto-elastic hyperlens.

17. The device according to claim 1, further comprising:

a multi-component lattice comprising said elastic material.

18. The device according to claim 17, wherein said multi-component lattice comprises one of a superlattice and a plurality of stacked lattices.

19. The device according to claim 3, wherein at least one of said first ceramic, said second ceramic, and said third ceramic comprises a piezoelectric material, wherein at least one of said first composite, said second composite, and said third composite comprises one of an electro-rheologic material and a magneto-rheologic material.

* * * * *